US007562605B2

(12) United States Patent
Kunkel et al.

(10) Patent No.: US 7,562,605 B2
(45) Date of Patent: Jul. 21, 2009

(54) DRAIN AND STRAINER WRENCH

(75) Inventors: Darrel G. Kunkel, Hot Springs, AR (US); Brian G. Kunkel, Hot Springs, AR (US); Gregory C. Miller, Lakewood, OH (US)

(73) Assignee: The Mill-Rose Company, Mentor, OH (US)

( * ) Notice: Subject to any disclaimer, the term of this patent is extended or adjusted under 35 U.S.C. 154(b) by 120 days.

(21) Appl. No.: 11/497,636

(22) Filed: Jul. 27, 2006

(65) Prior Publication Data

US 2007/0028726 A1 Feb. 8, 2007

Related U.S. Application Data

(60) Provisional application No. 60/704,626, filed on Aug. 2, 2005.

(51) Int. Cl.
*B25B 13/56* (2006.01)

(52) U.S. Cl. ..... 81/176.15; 81/176.1

(58) Field of Classification Search ..... 81/176.1, 81/176.15

See application file for complete search history.

(56) References Cited

U.S. PATENT DOCUMENTS

| | | | | |
|---|---|---|---|---|
| D311,315 | S * | 10/1990 | Duke | D8/25 |
| 5,103,698 | A | 4/1992 | Delaney | |
| 6,058,813 | A * | 5/2000 | Bryant et al. | 81/176.15 |
| 6,349,624 | B1 * | 2/2002 | Fahringer | 81/441 |
| 6,360,636 | B1 | 3/2002 | Elftmann | |
| 6,895,838 | B2 * | 5/2005 | Stahnke | 81/176.15 |
| 6,978,528 | B1 | 12/2005 | Stallings | |
| 7,013,764 | B2 | 3/2006 | Leatherby | |
| 7,024,972 | B2 | 4/2006 | Werner | |
| 7,121,172 | B1 | 10/2006 | Daniels | |
| 2003/0015067 | A1 | 1/2003 | Lawson | |
| 2004/0020336 | A1 | 2/2004 | Farrell | |
| 2005/0050632 | A1 | 3/2005 | Leatherby | |
| 2006/0123538 | A1 | 6/2006 | Mayer | |
| 2006/0123539 | A1 | 6/2006 | Mayer | |

* cited by examiner

*Primary Examiner*—Joseph J Hail, III
*Assistant Examiner*—Shantese McDonald
(74) *Attorney, Agent, or Firm*—Fay Sharpe LLP; Brian E. Turung

(57) ABSTRACT

A wrench that includes a handle and a tool head. The tool head is positionable in a plurality of positions relative to the handle. The wrench is useful in installing and repairing shower drains and sink drains and other similar drain arrangements.

26 Claims, 6 Drawing Sheets

DRAIN AND STRAINER WRENCH

The invention claims priority on U.S. Provisional Patent Application Ser. No. 60/704,626 filed Aug. 2, 2005, which is incorporated herein by reference.

The present invention is directed to plumber's tools, and more particularly to a wrench, and still more particularly to a drain and/or strainer wrench.

BACKGROUND OF THE INVENTION

Many households currently include showers. When a shower is installed, the shower drain must be tightened at the bottom of the shower to form a watertight seal. The sealing of the shower drain is typically accomplished by the use of plumber's putty and/or another sealant that is applied to the rim of the shower drain, and the shower drain is then placed in the existing hole of the shower stall. The body of the shower drain includes male threads. A sealing ring, typically formed of brass, having female threads is then threaded onto the drain body and then tightened against the bottom of the shower so as to form the watertight seal.

The sealing ring typically includes small tabs (usually four or more) that enable the installer to grip the ring so that the sealing ring can be tightened on the body of the drain. The tightening procedure is typically accomplished with a set of pliers. The base of the shower stall is commonly formed of a wood frame that includes attached fiberglass. The wooden frame often extends out past the drain, thereby interfering with easy access to the sealing ring. As such, the tightening of the sealing ring on the body of the drain to form a watertight seal can be very difficult and time consuming. In addition, the limited and/or obstructed access to the sealing ring can make it difficult to properly tighten the sealing ring on the body of the drain, thereby potentially resulting in an improper seal being formed.

Strainers are also commonly used with sink and shower drains. These strainers are commonly formed of metal or plastic and commonly include a hexagonal shaped nut that is used to seal the strainer to a sink or shower. These hexagonal nuts are similar in size to the sealing rings. Similar problems exist for these hexagonal shaped nut as with the sealing rings when attempting to tighten the hexagonal shaped nut when access to the hexagonal shaped nut is limited and/or obstructed.

In view of the current state of the art of plumbing tools, there is a demand for a wrench that can be used to more easily and conveniently access and tighten a strainer and/or a sealing ring of a drain.

SUMMARY OF THE INVENTION

The present invention is generally directed to plumber's tools, and more particularly to a wrench, and still more particularly to a wrench, and even more particularly to a wrench for use on sink and/or shower stall drains. Although the wrench will be particularly described with reference to a sealing ring or strainer wrench for use on sink and/or shower stall drains, it will be appreciated that the wrench has many other plumbing and non-plumbing applications, all of which are encompassed by the present invention.

The wrench of the present invention is designed to make it more convenient to tighten a stainer and/or sealing ring on the body of a drain. In the housing industry, prefabricated shower stalls are commonly formed of fiberglass and/or other fiber and/or resin materials. These prefabricated shower stalls include a hole in the shower stall bottom that is designed to receive a shower drain. The shower drain, which is commonly formed of a metal such as brass, has to be tightened in the bottom of the shower so as to form a watertight seal. The watertight seal is commonly formed by applying plumber's putty or some other sealant to the bottom side lip or rim of the shower drain. After the putty or sealant has been applied, the body of the drain is inserted through the hole in the shower stall until the lip or rim of the shower drain engages the bottom of the shower stall. The body of the shower drain is typically threaded so as to receive a sealing ring. The sealing ring is commonly formed of a metal material, however, this is not required. The sealing ring is designed to be tightened on the body of the shower drain until a watertight seal is formed between the lip or rim of the shower drain and the bottom of the shower stall. The sealing ring commonly includes a plurality of small tabs (e.g., usually four or more) that enable an installer such as a plumber to grip and turn the sealing ring so that the sealing ring can be properly tightened on the body of the shower drain. In one non-limiting embodiment of the invention, the wrench of the present invention is designed to enable an installer to more easily access and/or tighten the sealing ring and to enable the installer to easily tighten the sealing ring on the body of the shower drain so as to properly form a watertight seal. Commonly, shower stalls have a wooden frame that extends out past the drain thereby making it difficult in the past to access and tighten the sealing ring on the body of the drain body. The wrench of the present invention can be used to at least partially overcomes this past problem In another and/or additional embodiment of the invention, the wrench of the present invention is designed to enable an installer to more easily access and/or tighten the strainer to enable the installer to easily tighten the strainer in a shower and/or sink so as to properly form a watertight seal.

In one non-limiting aspect of the present invention, the wrench of the present invention includes a "first cup" on one end of the wrench. The "first cup" has a generally cylindrical shape however, this is not required. The front edge of the "first cup" includes a plurality of notches or tabs that are designed to at least partially receive and engage one or more of the tabs on the sealing ring and/or strainer. The notches or tabs are typically positioned symmetrically about the front edge; however, this is not required. The "first cup" at least partially functions as a socket type wrench that slips at least partially on one or more of the tabs on the sealing ring and/or strainer so as to facilitate in the tightening of the sealing ring and/or strainer on a sink and/or the body of the shower drain. The "first cup" typically has an interior cavity; however, this is not required. The interior cavity typically extends a majority of the longitudinal length of the "first cup" however, this is not required. The interior cavity typically has a circular cross-sectional shape; however, this is not required. The interior cavity typically has a uniform cross-sectional area along the longitudinal length of the interior cavity; however, this is not required. The "first cup" can be formed of a variety of materials such as, but not limited to, metal, ceramic, plastic, fiberglass, etc. In one non-limiting embodiment of the invention, the "first cup" is at least partially formed of a polymer material that is extruded and/or molded into at least a portion of the "first cup". In another and/or additional one non-limiting embodiment of the invention, the "first cup" has a generally cylindrical shape. In one non-limiting aspect of this embodiment, the maximum cross-sectional outer diameter of the "first cup" is about 3-5 inches, and typically about 3.5-4.5 inches; however, it will be appreciated that other sizes for the maximum cross-sectional outer diameter of the "first cup" can be used. In another and/or additional non-limiting aspect of this embodiment, the maximum cross-sectional inner diameter of the "first cup" is about 2.95-4.95 inches, and typically about 3.45-4.45 inches; however, it will be appreciated that other sizes for the maximum cross-sectional outer diameter of the "first cup" can be used. In still another and/or additional one non-limiting embodiment of the invention, the "first cup" has an inner cavity depth and enables the first cup to at least partially fit a variety of different strainer and/or sealing rings. In one non-limiting aspect of this embodiment, the maximum cavity depth of the "first cup" is about 0.5-5 inches, and typically about 2-4 inches; however, it will be appreciated that other maximum cavity depths for the "first cup" can be used. In yet another and/or additional one non-limiting embodiment of the invention, the "first cup" includes at least four (4) notches or tabs. In one non-limiting aspect of this embodiment, the "first cup" includes 4-20 notches or tabs, and typically 4-11 notches or tabs; however, it will be appreciated that the "first cup" can include other numbers of notches or tabs. In another and/or additional non-limiting aspect of this embodiment, the notches or tabs on the "first cup" can have the same or different shape. In one non-limiting design, all the notches or tabs have the same shape. In another non-limiting design, at least one notch or tab has a different shape, width and/or depth from one or more other notches or tabs. In still another and/or additional non-limiting design, the maximum width of the notches or tabs is about 0.1-1 inch, and typically about 0.25-0.5 inch; however, it will be appreciated that maximum width of the notches of the "first cup" can have other sizes. In still yet another and/or additional non-limiting design, the maximum depth/height of the notches/tabs is about 0.1-1 inch, and typically about 0.2-0.5 inch; however, it will be appreciated that maximum depth/height of the notches/tabs of the "first cup" can have other sizes.

In another and/or alternative non-limiting aspect of the present invention, the wrench of the present invention includes one or more tabs having a tapered interior region. The taper on the one or more tabs can be selected to receive different shaped nuts (e.g., hexagon shaped nuts, pentagon shaped nuts, etc.). In one non-limiting embodiment of the invention, a plurality of tabs include a taper. The taper on one or more tabs may be the same or different. In another and/or additional non-limiting embodiment of the invention, the degree of taper is generally about 1-85°, typically about 5-60°, and more typically about 20-40°; however, it will be appreciated that other taper angles can be used on the one or more tabs.

In another and/or alternative non-limiting aspect of the present invention, the wrench of the present invention includes a handle. In one non-limiting embodiment, the handle has a generally circular cross-sectional shape along the longitudinal length of the handle; however, it will be appreciated that many other cross-sectional shapes can be used. The cross-sectional area of the handle is typically uniform along the longitudinal length of the handle; however, this is not required. The handle is typically formed of a metal material (e.g., carbon steel, stainless steel, aluminum, etc.), fiberglass material, plastic material, wood material, composite material; however, it will be appreciated that other or additional material can be used. In another and/or additional non-limiting embodiment of the invention, the length of the handle is generally about 4-30 inches, and more typically about 10-15 inches; however, other lengths can be used. In another and/or additional non-limiting embodiment of the invention, the handle can include one or more pin openings. The one or more pin openings are typically positioned at the center portion of the handle near one or more ends of the handle; however, this is not required. In one non-limiting aspect of this embodiment, the one or more pin openings can be designed to receive one or more pins used to at least partially connect the "first cup" to the handle. As can be appreciated, many other configurations can be used to secure the handle to the "first cup". In another and/or additional aspect of this embodiment, the one or more pin openings can be designed to enable the handle to be positioned at multiple angles relative to the "first cup" (e.g., from straight vertical to horizontal, etc.) so as to gain maximum leverage when tightening or removing the sealing ring from the body of the shower drain. It is common that the installation or removal of the sealing ring from the body of the shower drain is done while the installer is lying on his/her back in an open area. When a shower is installed on a wood floor, a hole is cut in the wood floor, under the shower drain to allow piping to be installed in the shower drain. There is usually a space between the wood floor and the shower drain when the shower is put in place. This space can be just one or two inches or can be several inches (e.g., three to four inches, etc.). The adjustable positioning of the handle relative to the "first cup" enables the installer to easily access the sealing ring and the body of the drain so that the installer can easily install or remove the sealing ring from the shower drain that is positioned in the hole in the wood floor. The handle allows the installer to end a portion of the handle through the hole on the wood floor and to place the "first cup" at least partially about the sealing ring and then tighten the sealing on the body of the shower drain to form a water tight seal, or to remove the sealing ring from the body of the shower drain to repair (e.g., reapply plumber's putty or sealant, replace shower drain, repair crack in fiberglass about the drain hole, etc.). In one non-limiting design, for a handle having a length of about 10-15 inches, the pin opening is position about 0.2-1 inch, and typically about 0.25-0.4 inch from the end of the handle; however, other distances can be used. As can be appreciated, the pin opening may be closer to the end of the handle when the handle is smaller; however, this is not required. The size of the one or more pin openings on the handle is non-limiting. The one or more pin openings typically pass through the complete width of the handle; however, this is not required. The cross-sectional shape of the pin opening is typically circular; however, this is not required. The cross-sectional area of the pin opening along the length of the pin opening is generally constant; however, this is not required. When the handle includes two or more pin openings, the size and shape of the pin openings are typically the same; however, this is not required. A permanent or removable pin is typically used to secure the "first cup" to the handle. Typically, the pin enables the "first cup" to be rotatably or pivotally connected to the handle so that the "first cup" can be more easily positioned on the sealing ring; however, this is not required. When the pin is removable, the "first cup" can be removably connected to the handle. When the handle includes two or more pin openings, the removable pin enables the "first cup" to be connected and disconnected to these various pin openings. In one non-limiting design, the handle has a generally circular cross-sectional shape and the diameter of cross-section is about 0.4-0.75 inch and the diameter of one or more of the pin openings is about 0.15-0.5 inch; however, other sizes for one or both of these dimensions can be used.

In still another and/or alternative non-limiting aspect of the present invention, the "first cup" includes one or more handle slots; however, this is not required. The one or more handle slots in the "first cup" enable the "first cup" to at least partially rotate or pivot relative to the handle. The one or more handle slots extend from the side of the "first cup". The one or more handle slots typically extend from the front to the rear edge of the "first cup" however, this is not required. Each handle slot is designed and sized to allow the handle to move at least partially in the slot. When the handle is rotatably or pivotally connected to the "first cup" the handle slot allows the "first cup" to move relative to the handle. In one non-limiting design, the handle is connected to the "first cup" such that the end of the handle can move relative to the "first cup". The one or more handle slots are configured in this non-limiting design to enable the end of the handle to move at least partially along the length of the handle slot. In one particular arrangement, the handle is connected in the plane of the base of the "first cup"; however, this is not required. In one non-limiting arrangement, a permanent or removable pin can be used to pass through the diameter of the handle and into one or more openings in the: first cup" so that the handle rotatably or pivotally connects to a portion of the "first cup." As can be appreciated, many other arrangements can be used to connect the handle to the "first cup." For instance, the handle can be pivotally connected to the side or bottom of the "first cup" without the need of a handle slot.

In still yet another and/or alternative non-limiting aspect of the present invention, the "first cup" includes a base opening. The base opening of the "first cup", when used, is typically spaced from the front edge of the "first cup". In one non-limiting design, the base opening is positioned closely adjacent to the back edge of the "first cup", however, it will be appreciated the base opening can be positioned in other regions between the front and rear edge of the "first cup." The base opening can be the same or smaller size as the interior cavity of the "first cup". The base opening is typically centered in the interior cavity; however, this is not required. In one non-limiting design, the rear edge of the "first cup" includes a back plate that is secured to the rear edge and which forms the base opening that has a size which is smaller than the size of the interior cavity and which base opening is centered in the interior cavity. The base opening can be used to secure the handle to the "first cup".

In yet another and/or alternative non-limiting aspect of the present invention, the wrench of the present invention includes a "second cup"; however, this is not required. The second cup is typically smaller in size than the "first cup"; however, this is not required. In one non-limiting design, the "second cup" is connected to "first cup"; however, it can be appreciated that the "first cup" and "second cup" can be two separate components. The "second cup" has a generally cylindrical shape however, this is not required. The front edge of the "second cup" includes a plurality of notches or tabs that are designed to at least partially receive and engage one or more pipes and/or seals. The notches or tabs are typically positioned symmetrically about the front edge; however, this is not required. The "second cup", like the "first cup", can at least partially function as a socket type wrench that slips at least partially on one or more of the tabs on a pipe or seal so as to facilitate in the tightening of the pipe or seal. The "second cup" typically has an interior cavity; however, this is not required. The interior cavity typically extends a majority of the longitudinal length of the "second cup" however, this is not required. The interior cavity typically has a circular cross-sectional shape; however, this is not required. The interior cavity typically has a uniform cross-sectional area along the longitudinal length of the interior cavity; however, this is not required. The "second cup" can be formed of a variety of materials such as, but not limited to, metal, ceramic, plastic, fiberglass, etc. In one non-limiting example, the "second cup" is at least partially formed of a polymer material that is extruded and/or molded into at least a portion of the "second cup". In one non-limiting manufacturing process, the "first cup" and the "second cup" are molded components that are formed into a single component wherein the front edge of each cup are oppositely facing. The "second cup" can be designed to be used to tighten or move components other than the sealing ring. For instance, once the sealing is properly tightened on the body of the shower drain, a drainpipe is typically installed. This drainpipe is typically two or more includes long. The inside of the body of the shower drain commonly includes threads to receive the drainpipe. A rubber sleeve is commonly placed in the interior of the body of the drain, and a small ring having threads is then threaded in the interior of the shower drain. The drainpipe is then placed in the rubber sleeve. As the small ring is tightened, the ring compresses the sleeve against the drainpipe thereby forming a watertight seal. This smaller ring typically includes a plurality of notches or tabs that are cut in the ring and which are used to tighten and remove the ring. The notches or tabs in the front edge of the "second cup" form at least one tooth or several teeth that are designed to at least partially engage the notches or tabs in the small ring. In another and/or additional one non-limiting embodiment of the invention, the "second cup" has a generally cylindrical shape. In one non-limiting aspect of this embodiment, the maximum cross-sectional outer diameter of the "second cup" is about 2-4 inches, and typically about 2.25-3.25 inches; however, it will be appreciated that other sizes for the maximum cross-sectional outer diameter of the "second cup" can be used. In another and/or additional non-limiting aspect of this embodiment, the maximum cross-sectional inner diameter of the "second cup" is about 1.75-3.95 inches, and typically about 2.2-3.2 inches; however, it will be appreciated that other sizes for the maximum cross-sectional outer diameter of the "second cup" can be used. In still another and/or additional one non-limiting embodiment of the invention, the "second cup" has an inner cavity depth and enables the "second cup" to at least partially fit a variety of different strainer and/or sealing rings. In one non-limiting aspect of this embodiment, the maximum cavity depth of the "second cup" is about 0.25-2 inches, and typically about 0.5-1.5 inches; however, it will be appreciated that other maximum cavity depths for the "second cup" can be used. In yet another and/or additional one non-limiting embodiment of the invention, the "second cup" includes at least two (2) notches or tabs. In one non-limiting aspect of this embodiment, the "second cup" includes 3-9 notches or tabs, and typically 4-6 notches or tabs; however, it will be appreciated that the "second cup" can include other numbers of notches or tabs. In another and/or additional non-limiting aspect of this embodiment, the notches or tabs on the "second cup" can have the same or different shape. In one non-limiting design, all the notches or tabs have the same shape. In another non-limiting design, at least one notches or tabs has a different shape, width and/or depth from one or more other notches or tabs. In still another and/or additional non-limiting design, the maximum width of the notches or tabs is about 0.1-1 inch, and typically about 0.25-0.5 inch; however, it will be appreciated that maximum width of the notches of the "first cup" can have other sizes. In still yet another and/or additional non-limiting design, the maximum depth/height of the notches/tabs is about 0.1-1 inch, and typically about 0.15-0.5 inch; however, it will be appreciated that maximum depth/height of the notches/tabs of the "first cup" can have other sizes.

In still yet another and/or alternative non-limiting aspect of the present invention, the "second cup" includes one or more handle slots; however, this is not required. The one or more handle slots in the "second cup" enables the "second cup" to at least partially rotate or pivot relative to the handle. The one or more handle slots extend from the side of the "second cup". The one or more handle slots typically extend from the front to the rear edge of the "second cup" however, this is not required. Each handle slot is designed and sized to allow the handle to move at least partially in the slot. When the handle is rotatably or pivotally connected to the "second cup" the handle slot allows the "second cup" to move relative to the handle. In one non-limiting design, the handle is connected to the "second cup" such that the end of the handle can move relative to the "second cup". The one or more handle slots are configured in this non-limiting design to enable the end of the handle to move along the length of the handle slot. In one particular non-limiting arrangement, the handle is connected in the plane of the base of the "second cup"; however, this is not required. In this arrangement, the permanent or removable pin passes through the diameter of one or more the openings wherein the pin engages and rotatably or pivotally connects one end portion of the handle to the "second cup." As can be appreciated, many other arrangements can be used to connect the handle to the "second cup." For instance, the handle can be pivotally connected to the side or bottom of the "second cup" without the need of a handle slot. Furthermore, it will be appreciated that the handle can be connected to the "second cup" by means other than the use of one or more pins. When the "first cup" and the "second cup" are formed into a single part, the handle slot of the "first cup" is typically aligned with the handle slot of the "second cup"; however, this is not required. When the handle slots are aligned, the handle on the wrench can be rotated or pivoted into the different handle slots of the "first cup" and the "second cup" without having to disconnect the two cups from the wrench. In one non-limiting design, the handle slots of the "first cup" and the "second cup" are arranged to allow the handle to move about 20-340° so that the handle can be positioned in a position to enable the best leverage when using both cups. As can be appreciated, the handle slots can be arranged to enable the handle to move in other degrees of rotation.

In another and/or alternative non-limiting aspect of the present invention, the "second cup" includes a base opening. The base opening, when used, is typically spaced from the front edge of the "second cup". In one non-limiting design, the base opening is positioned closely adjacent to the back edge of the "second cup" however, it will be appreciated the base opening can be positioned in other regions between the front and rear edge of the "second cup." The base opening can be the same or a smaller size as the interior cavity of the "second cup". The base opening is typically centered in the interior cavity; however, this is not required. In one non-limiting design, the rear edge of the "second cup" includes a back plate that is secured to the rear edge and which forms the base opening that has a size which is smaller than the size of the interior cavity, and which base opening is centered in the interior cavity. The base opening can be used to secure the handle to the "second cup".

In a further and/or alternative non-limiting aspect of the present invention, the handle includes a gripping arrangement to facilitate in the gripping of the handle during the use of the wrench. In one non-limiting embodiment of the invention, the gripping arrangement includes a bar or pin that secures to one end of the handle to form a "T" shaped structure; however, it will be appreciated that other or additional gripping arrangements can be used. In one non-limiting aspect of this embodiment, the handle includes an opening at or near the end of the handle that is designed to at least partially receive the bar or pin that forms the "T" shaped structure. The bar or pin can be designed to be removably or permanently connected to the handle. In another and/or additional non-limiting embodiment of the invention, the gripping arrangement includes a polymer and/or rubber coating. In still another and/or additional non-limiting embodiment of the invention, the gripping arrangement includes a rough surface, ribs, notches or tabs, etc.

As stated above, the wrench of the present invention is not limited for use with shower drains. For instance, the wrench can be used in kitchen sink drains. Many kitchen sink drains, or basket strainers, are similar in construction to the shower drain. Both commonly have a ring with threads that tightens on the drain body that has threads for a seal. The wrench of the present invention can be designed to at least partially engage such sealing rings. In one non-limiting application, seal rings for sinks commonly include anywhere from four to eight tabs. The "first cup" can be designed to include eight or more notches or tabs that are designed to at least partially engage such seal ring. During installation of the sink drain, plumber's putty or another type of sealant is applied to the rim or lip of the drain, and then the body of the drain is inserted in the existing drain hole in the sink. The sealing ring is then threaded on the drain body and tightened in a similar manner as the tightening of the sealing ring on the body of the shower drain. This installation for the sink drain is usually done before the sink is placed in the cabinet; however, due to the versatility of the wrench of the present invention, the drain can be easily inserted after the sink has been placed in the cabinet. The design of the wrench is also very useful for repair work that needs to be done on an installed sink. When the drain leaks, the wrench can be used under the sink and in the cabinet to loosen the sealing ring so that a proper watertight seal can be formed. Many kitchen sinks include two or more compartments, therefore repair is difficult considering there are many obstacles to deal with under the sink, such as, but not limited to, disposals, drain piping, water filters, insta-hot, storage shelves, and/or water supplies. The novel design of the wrench of the present invention enables the wrench to be used in many different positions, thereby enabling an installer or repairer to more easily complete the project involving the drain.

It is one non-limiting object of the present invention to provide a wrench that simplifies the installation of a drain.

It is another and/or alternative non-limiting object of the present invention to provide a wrench that can be used to facilitate in the installation of a shower.

It is still another and/or alternative non-limiting object of the present invention to provide a wrench that can be used to facilitate in the installation of a sink.

It is yet another and/or alternative non-limiting object of the present invention to provide a wrench that includes a "first cup" that is pivotally or rotatably connected to a handle.

It is still yet another and/or alternative non-limiting object of the present invention to provide a wrench that includes a "first cup" and a "second cup" that is pivotally or rotatably connected to a handle and wherein the "first cup" is larger than the "second cup."

It is further another and/or alternative non-limiting object of the present invention to provide a wrench that includes a "first cup" and a "second cup" that are connected together.

It is still a further another and/or alternative non-limiting object of the present invention to provide a wrench that includes a "first cup" and a "second cup" that include one or more tabs and/or notches.

It is yet a further another and/or alternative non-limiting object of the present invention to provide a wrench that includes a "first cup" and a "second cup" that include one or more tapered tabs and/or notches.

These and other advantages will become apparent to those skilled in the art upon the reading and following of this description taken together with the accompanying drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION OF THE INVENTION

Figure 1:
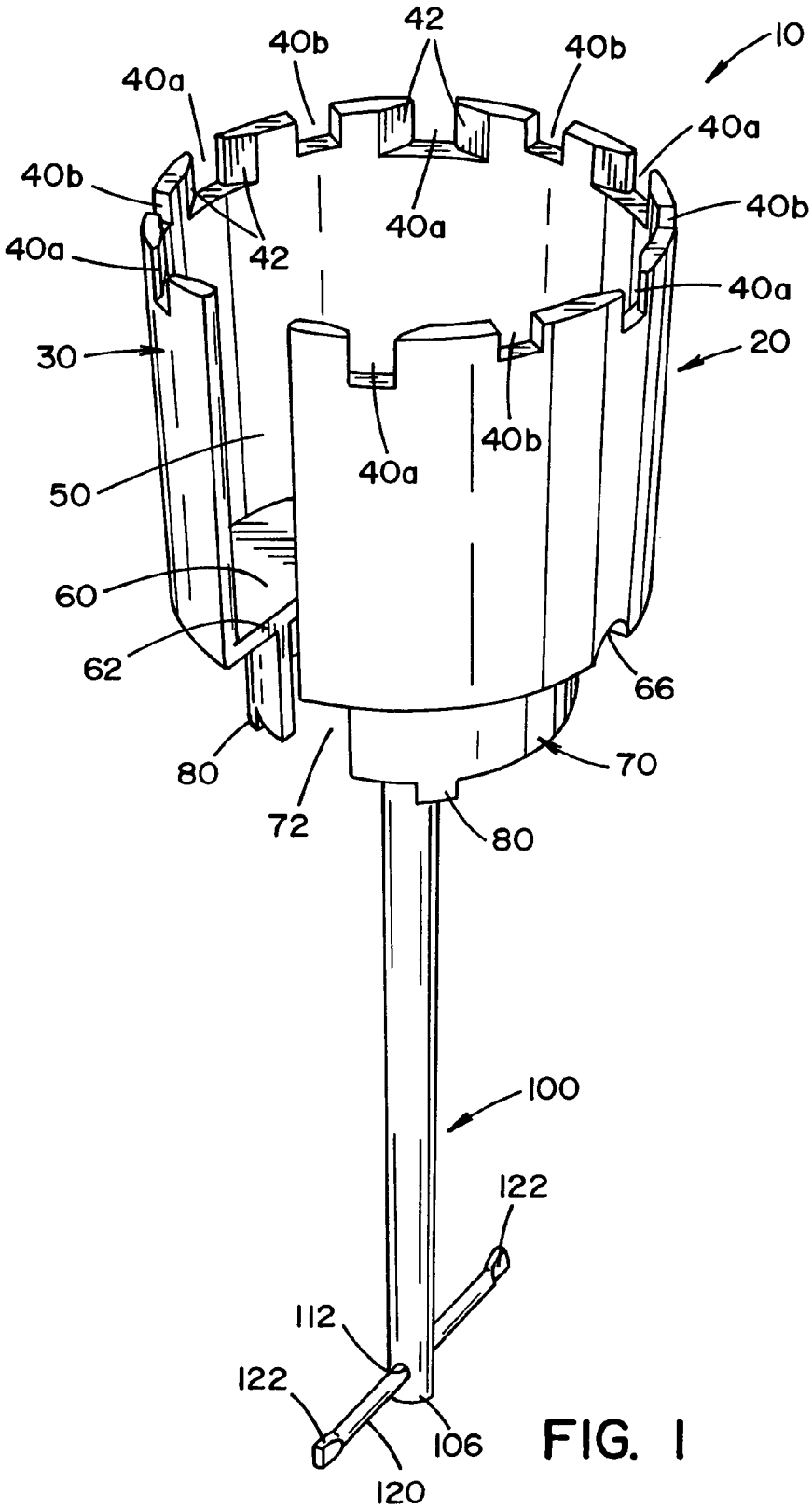
FIG. 1 is a perspective view of the wrench in accordance with the present invention.

Referring now to the drawings wherein the showings are for the purpose of illustrating embodiments of the invention only and not for the purpose of limiting the same, FIGS. 1-6 illustrate one non-limiting arrangement for the wrench of the present invention. The wrench disclosed in FIGS. 1-6 is particularly useful in installing and/or repairing drains for showers and sinks; however, the one or more features of the wrench can be used on wrenches of other or additional applications, and the present invention is intended to cover such other applications.

Referring now to FIG. 1, the wrench 10 includes two primary components, namely a tool head 20 and a handle 100. The tool head can be formed of a variety of materials (e.g., plastic, metal, wood, composite materials, ceramic, etc.). The tool head is illustrated as being formed of a "first cup" 30 and a "second cup" 70. These two cups are connected together; however, this is not required. When the tool head is a molded component, the two cups are typically formed into a single piece; however, this is not required. As can be appreciated, the tool head can include only a single cup.

Figure 2:
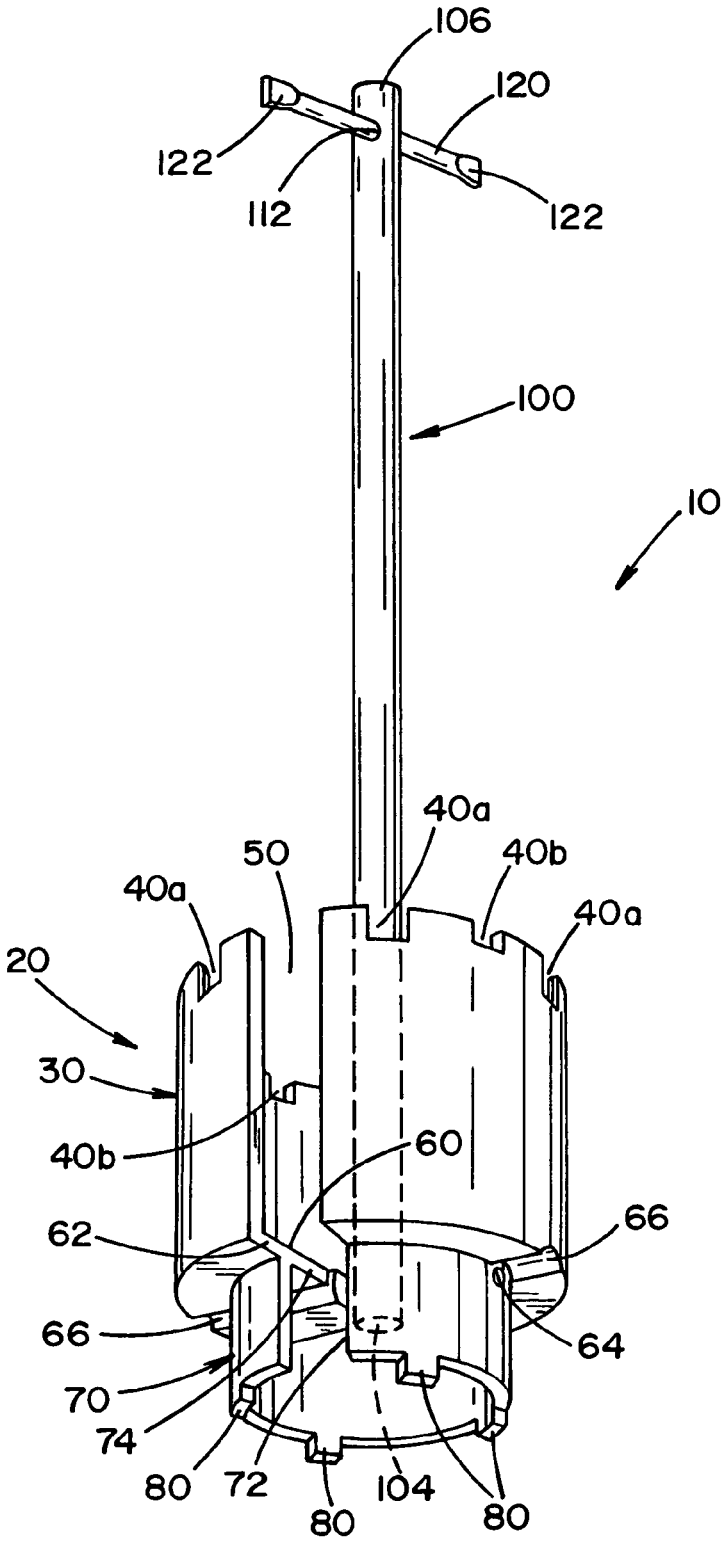
FIG. 2 is another perspective view of the wrench illustrated in FIG. 1.
Figure 3:
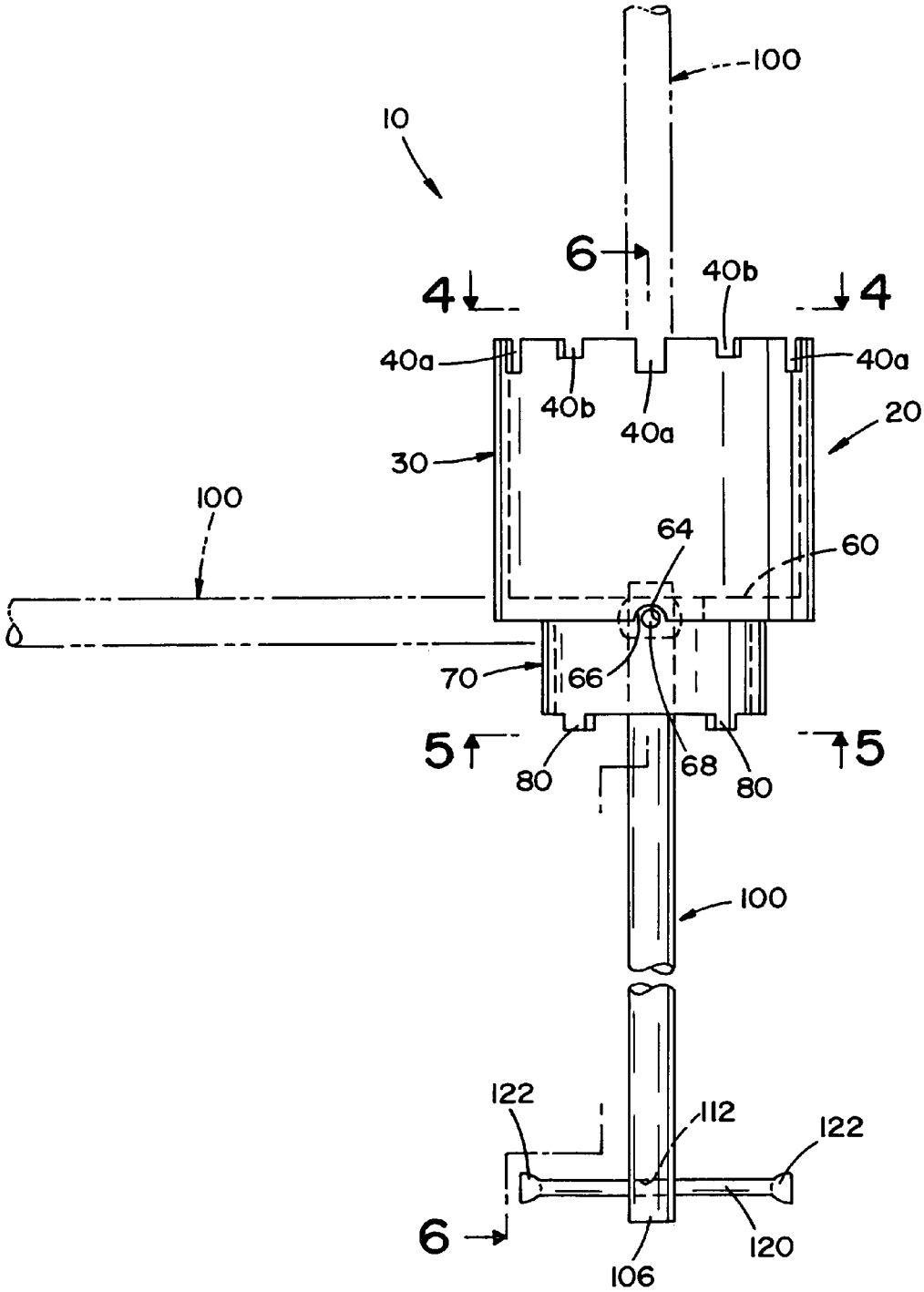
FIG. 3 is a side view of the wrench illustrated in FIG. 1 showing multiple positions of the handle of the wrench.
Figure 4:
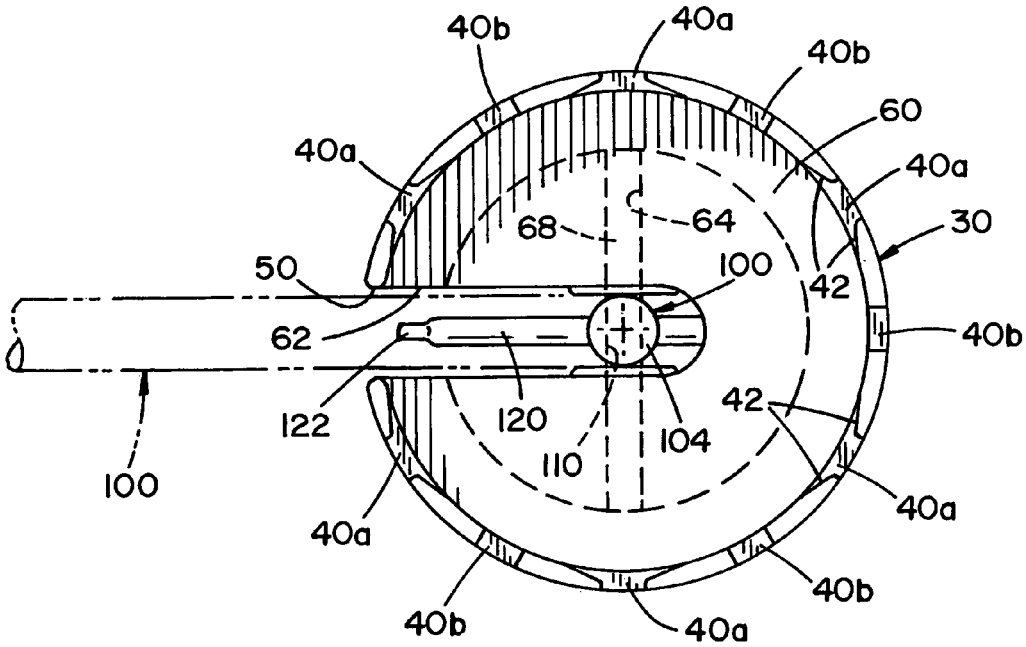
FIG. 4 is a elevational view along line 4-4 of FIG. 3.
Figure 5:
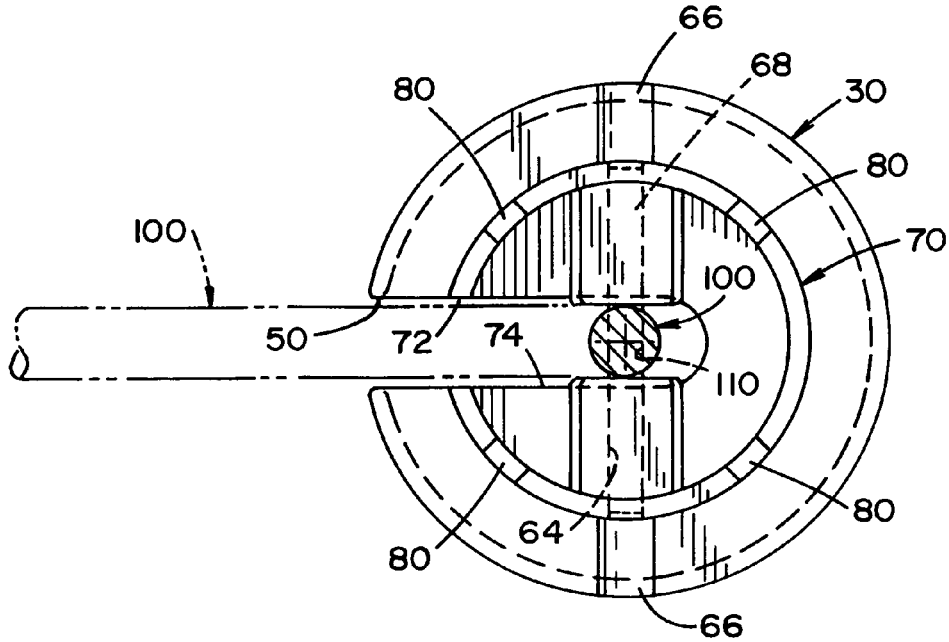
FIG. 5 is a cross-section view along line 5-5 of FIG. 3.
Figure 6:
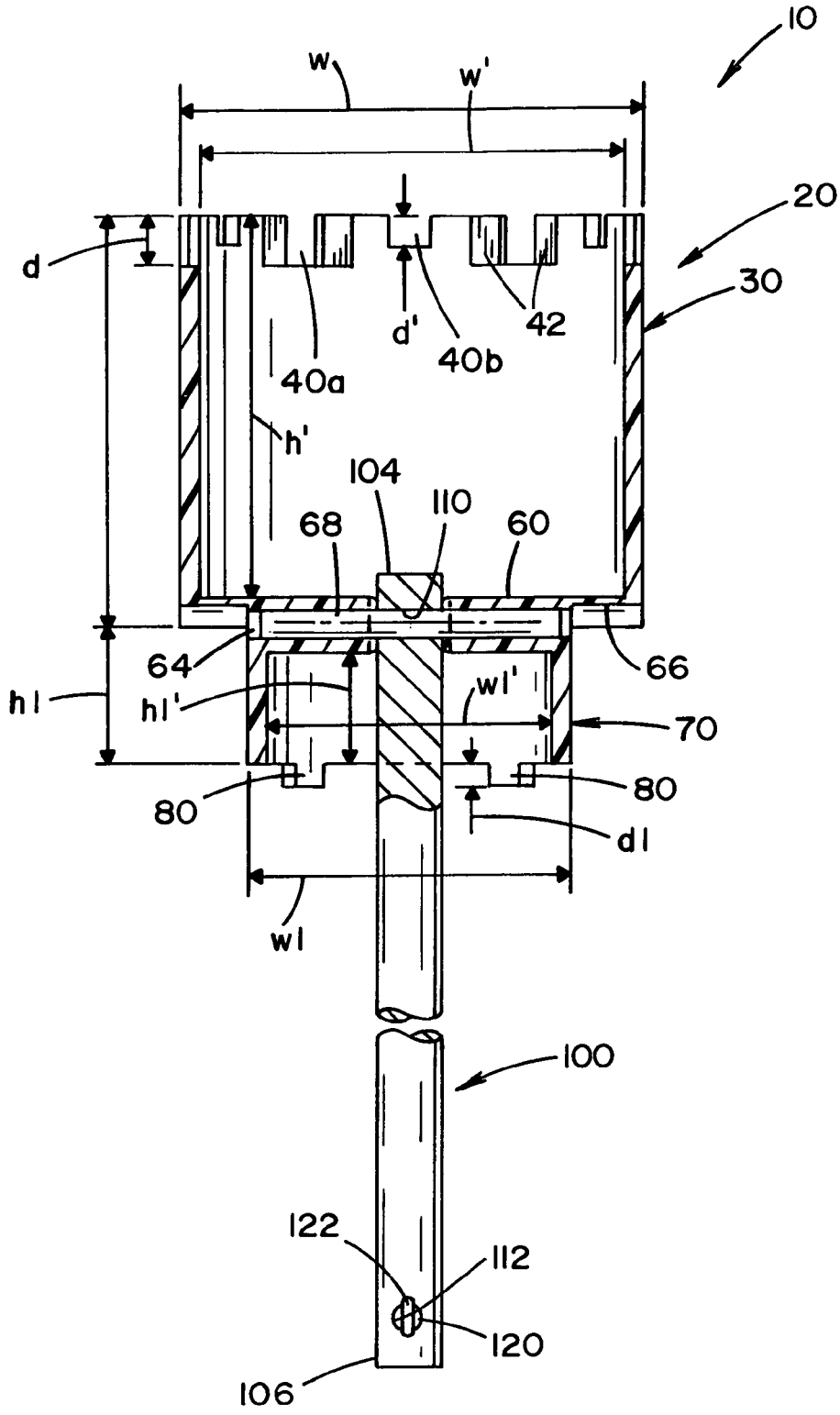
FIG. 6 is a cross-section view along line 6-6 of FIG. 3.
Figure 7:
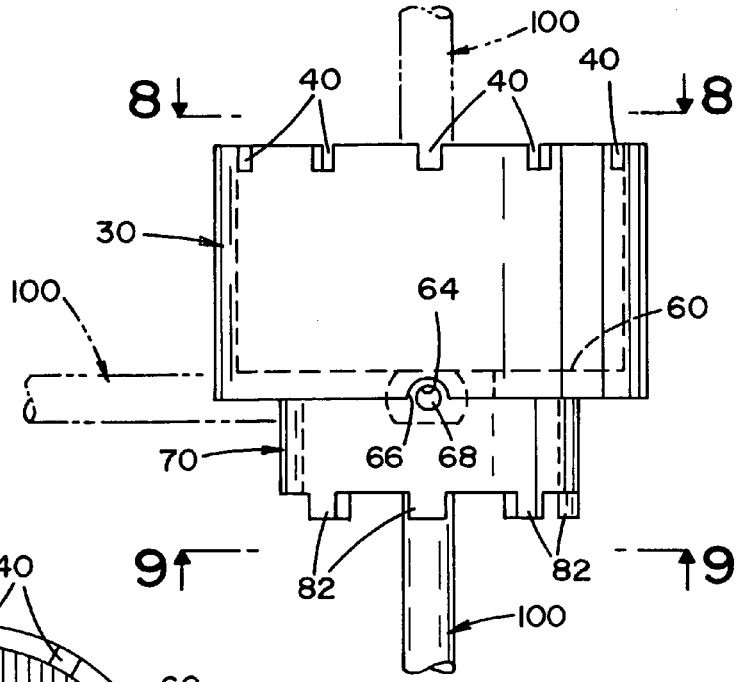
FIG. 7 is a modification of the wrench of FIG. 1.
Figure 8:
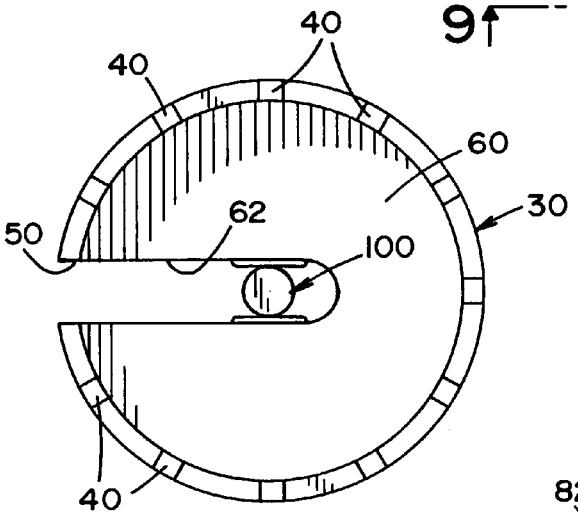
FIG. 8 is a elevational view along line 8-8 of FIG. 7.

As illustrated in FIGS. 1-6, "first cup" 30 is larger than "second cup" 70. Each cup has a generally cylindrical configuration however, this is not required. Many dimensions can be used for the "first cup" and the "second cup." In one non-limiting configuration, the "first cup" has a generally circular cross-sectional shape, a height "h" of about 4-5 inches, an inner height "h'" of about 2.25-3.5 inch, an outer width "w" of about 4.5-5.5 inches, and an inner width "w'" of about 4.25-5.25 inch. It will be appreciated that other dimensions and/or shapes of the "first cup" can be used. "First cup" 30 includes a plurality of notches 40*a*, 40*b*. The notches 40*a* have a different depth than notches 40*b*. As best illustrated in FIGS. 3 and 6, notches 40*a* have a depth "d" that is greater than the depth "d'" of notches 40*b*. As can be appreciated, notches 40*a* and 40*b* can be designed to same the same depth. The "first cup" is shown to have six types of notches 40*a* and five types of notches 40*b*. As can be appreciated, the "first cup" can have other numbers of notches 40*a* and/or 40*b*. Depth d is generally about 0.2-1 inch and depth d' is generally about 0.1-0.6 inch; however, it can be appreciated that other depths for d and/or d' can be used. The edges of notches 40*a* include a taper 42 of about 20-40°; however, other degrees of taper can be used. The tapered portion extends the full depth d of notches 40*a*; however, this is not required. The tapered surfaces enable the "first cup" to engage a hexagonal shaped nut that is commonly used for strainers. The notches on the "first cup" are also designed to engage nuts having 4, 6 or 8 tabs. As illustrated in FIGS. 7 and 8, the size and shape of the eleven notches 40 are the same and do not include a tapered surface.

As illustrated in FIGS. 1, 2, 4 and 5, the "first cup" includes a handle slot 50 and a base opening 62 in base plate 60. The handle slot enables a handle 100 to pivotally move so that the "first cup" can be easily positioned over a sealing ring or other component during the installation or repair of a drain, etc. Furthermore the slot enables the user to position the handle relative to the "first cup" so that the user can apply the desired, or best, force on the tool head during the installation or repair of a drain, etc.

Tool head 20 includes an opening 64 in the base plate 60 that is designed to receive fixed pin 68. As shown in FIGS. 4-6, the opening 64 passes through at least a portion of base plate 60. Two access indents 66 are positioned on both sides of the opening. As can be appreciated, one or both of the slots can be eliminated. Pin 68 is designed to pass into opening 64 and through pin opening 110 in handle 100 thereby pivotally securing handle 100 to tool head 20. Base opening 62 is sized large enough so that a top end 104 end of handle 100 can freely move within the base opening as a portion of the handle moves with handle slot 50. As can be appreciated, other arrangements can be used to pivotally secure handle 100 to the tool head. Handle 100 is illustrated as being generally cylindrically shaped, however, this is not required. The handle can be formed of a variety of materials (e.g., metal, plastic, wood, composite materials, etc.). The handle can be hollow, or partially or fully solid. The length of the handle is generally about 5-20 inches and has a diameter of about 0.3-1 inch; however, other dimensions of the handle can be used. The handle includes a top end 104 and a bottom end 106. A pin opening 110, 112 is located closely adjacently to each end. In one non-limiting arrangement, each pin opening is positioned about 0.25-1 inch from the end of the handle; however, other distances can be used. Each pin opening extends through the handle; however, this is not required. Each pin opening typically has a diameter of about 0.25 inch; however, other sizes can be used. Pin opening 112 is designed to receive pin 120 so that handle 100 can be easily grasped and/or twisted. Pin 120 can be a fixed or a removable pin. The pin can be a floating pin designed to be movably positioned in opening 112; however, this is not required. In such a configuration, pin 120 can include nodules 122 to prevent the pin from fully passing through opening 112. When pin 120 is positioned halfway in opening 112, pin 120 forms a "T" shape at the end of the handle. Pin 120 is designed to improve the grasping of the handle during the use of the wrench. Pins 68 and 120 are shown to have a generally circular cross-sectional shape; however, this is not required. Pin 68 generally has a length of about 2-6 inches, and pin 120 generally has a length of about 2-4; however, other lengths can be used.

Figure 9:
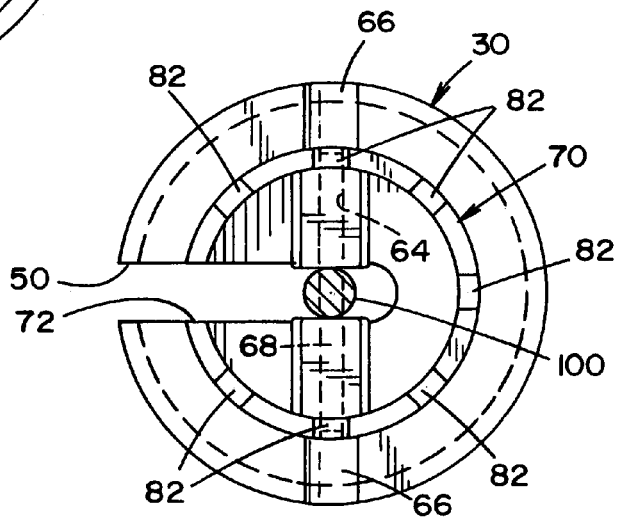
FIG. 9 is a cross-section view along line 9-9 of FIG. 7.

Tool head 20 also includes a "second cup" 70 that is connected to base plate 60. The "second cup" has a generally circular cross-sectional shape, a height "h1" of about 0.75-2 inches, an inner height "h1'" of about 0.5-1.5 inch, an outer width "w1" of about 2-3.5 inches, and an inner width "w1'" of about 1.5-3 inch. It will be appreciated that other dimensions and/or shapes of the "second cup" can be used. "Second cup" 70 includes a plurality of tabs 80. As best illustrated in FIGS. 1, 2, 3, 5 and 6, the "second cup includes four tabs. As best illustrated in FIGS. 3 and 6, tabs 80 have a height "d1" of about 0.2-1 inch; however, it can be appreciated that other heights can be used. The "second cup" is shown to have four tabs 80; however, it can be appreciated that "second cup" can have other numbers of tabs. The tabs on the "second cup" are designed to engage nuts having 4, 6 or 8 notches. In another configuration of the "second cup" as illustrated in FIGS. 7 and 9, the "second cup" includes seven tabs 82. The "second cup" has similar features as the "second cup" illustrated in FIGS. 1-6. The height of tabs 82 are generally about 0.2-1 inch; however, it can be appreciated that other heights can be used.

As illustrated in FIGS. 1, 2 and 5, the "second cup" includes a handle slot 72 and a base opening 74 in base plate 60. The handle slot enables handle 100 to pivotally move so that the "second cup", like the "first cup", can be easily positioned in multiple positions as illustrated in FIG. 3 so that the tool head can be positioned over a sealing ring or other component during the installation or repair of a drain, etc. Furthermore, the slot enables the user to position the handle relative to the "second cup" so that the user can apply the desired, or best, force on the tool head during the installation or repair of a drain, etc.

It will thus be seen that the objects set forth above, among those made apparent from the preceding description, are efficiently attained, and since certain changes may be made in the constructions set forth without departing from the spirit and scope of the invention, it is intended that all matter contained in the above description and shown in the accompanying drawings shall be interpreted as illustrative and not in a limiting sense. The invention has been described with reference to preferred and alternate embodiments. Modifications and alterations will become apparent to those skilled in the art upon reading and understanding the detailed discussion of the invention provided herein. This invention is intended to include all such modifications and alterations insofar as they come within the scope of the present invention. It is also to be understood that the following claims are intended to cover all of the generic and specific features of the invention herein described and all statements of the scope of the invention, which, as a matter of language, might be said to fall therebetween.

We claim:

1. A plumbing tool that includes a handle and a tool head, said tool head positionable in a plurality of positions relative to the handle, said tool head being pivotally connected to said handle, said tool head including a first cup and a second cup, said first cup including a first base, a first side wall extending upwardly from said first base, a first cavity and a first end, said second cup including a second base, a second side wall extending upwardly from said second base, a second cavity and a second end, each of said first and second ends including a plurality of notches, tabs, slots, and combinations thereof, said first cup including a first handle slot in said first side wall and said second cup including a second handle slot in said second side wall, said first and second handle slots having a width to enable said handle to at least partially move within at least a portion of a length of said first and second handle slots, said first and second handle slots aligned with one another such that said handle can move within said first and second cavities as said handle moves between said first and second handle slots.

2. The plumbing tool as defined in claim 1, wherein said first base includes a first base slot and said second base includes a second base slot, said first and second base slots having a width to enable said handle to at least partially move within at least a portion of a length of said first and second base slots, said first and second base slots aligned with one another such that said handle can move between said first and second base slots.

3. The plumbing tool as defined in claim 2, wherein said first handle slot has a longitudinal length that is greater than a longitudinal length of said second handle slot.

4. The plumbing tool as defined in claim 3, wherein said handle is pivotally connected between said first end of said first cup and said second end of said second cup.

5. The plumbing tool as defined in claim 4, wherein said handle is pivotally connected to said first base, said second base, and combinations thereof.

6. The plumbing tool as defined in claim 5, wherein at least one of said notches, slots, and combinations thereof on said first end of said first cup is tapered.

7. The plumbing tool as defined in claim 6, wherein said first end has a cross-section area that is greater than a cross-sectional area of said second end.

8. The plumbing tool as defined in claim 7, wherein said first end and said second end face apart from one another, said first and second bases connected together.

9. The plumbing tool as defined in claim 8, wherein said first cavity having a greater volume than said second cavity.

10. The plumbing tool as defined in claim 9, wherein said first end of said first cup includes a plurality of notches, tabs, slots, and combinations thereof, a plurality of said notches, tabs, slots, and combinations thereof on said first end being space at an equal distance from one another, said second end of said second cup includes a plurality of notches, tabs, slots, and combinations thereof, a plurality of said notches, tabs, slots, and combinations thereof on said second end being space at an equal distance from one another.

11. The plumbing tool as defined in claim 10, wherein said first cup and said second cup each have generally circular cross-sectional areas, said first cavity and said second cavity each have generally circular cross-sectional areas.

12. The plumbing tool as defined in claim 11, wherein said first base positioned at a farther distance from said first end than said second base from said second end, said first and second bases are formed of a common base.

13. The plumbing tool as defined in claim 2, wherein said handle is pivotally connected between said first end of said first cup and said second end of said second cup.

14. The plumbing tool as defined in claim 13, wherein said handle is pivotally connected to said first base, said second base, and combinations thereof.

15. The plumbing tool as defined in claim 14, wherein at least one of said notches, slots, and combinations thereof on said first end of said first cup is tapered.

16. The plumbing tool as defined in claim 2, wherein at least one of said notches, slots, and combinations thereof on said first end of said first cup is tapered.

17. The plumbing tool as defined in claim 1, wherein said handle is pivotally connected between said first end of said first cup and said second end of said second cup.

18. The plumbing tool as defined in claim 17, wherein said handle is pivotally connected to said first base, said second base, and combinations thereof.

19. The plumbing tool as defined in claim 18, wherein at least one of said notches, slots, and combinations thereof on said first end of said first cup is tapered.

20. The plumbing tool as defined in claim 1, wherein at least one of said notches, slots, and combinations thereof on said first end of said first cup is tapered.

21. The plumbing tool as defined in claim 1, wherein said first end has a cross-section area that is greater than a cross-sectional area of said second end.

22. The plumbing tool as defined in claim 1, wherein said first end and said second end face apart from one another, said first and second bases connected together.

23. The plumbing tool as defined in claim 1, wherein said first cavity having a greater volume than said second cavity.

24. The plumbing tool as defined in claim 1, wherein said first end of said first cup includes a plurality of notches, tabs, slots, and combinations thereof, a plurality of said notches, tabs, slots, and combinations thereof on said first end being space at an equal distance from one another, said second end of said second cup includes a plurality of notches, tabs, slots, and combinations thereof, a plurality of said notches, tabs, slots, and combinations thereof on said second end being space at an equal distance from one another.

25. The plumbing tool as defined in claim 1, wherein said first cup and said second cup each have generally circular cross-sectional areas, said first cavity and said second cavity each have generally circular cross-sectional areas.

26. The plumbing tool as defined in claim 1, wherein said first base positioned at a farther distance from said first end than said second base from said second end, said first and second bases are formed of a common base.

* * * * *